US010424850B2

(12) United States Patent
Major

(10) Patent No.: US 10,424,850 B2
(45) Date of Patent: Sep. 24, 2019

(54) SELF-LOCKING WIRE DEVICE AND METHOD OF USING THE SAME

(71) Applicant: Jonathan Major, Mascouche (CA)

(72) Inventor: Jonathan Major, Mascouche (CA)

(73) Assignee: Jonathan Major, Mascouche (CA)

( * ) Notice: Subject to any disclaimer, the term of this patent is extended or adjusted under 35 U.S.C. 154(b) by 0 days.

(21) Appl. No.: 15/788,775

(22) Filed: Oct. 19, 2017

(65) Prior Publication Data

US 2018/0109012 A1 Apr. 19, 2018

Related U.S. Application Data

(60) Provisional application No. 62/496,450, filed on Oct. 19, 2016.

(51) Int. Cl.

| | |
|---|---|
| ***H01R 25/00*** | (2006.01) |
| ***H01R 4/2404*** | (2018.01) |
| ***H01R 11/09*** | (2006.01) |
| ***H01R 4/48*** | (2006.01) |

(52) U.S. Cl.
CPC ..... *H01R 4/2404* (2013.01); *H01R 4/48* (2013.01); *H01R 11/09* (2013.01)

(58) Field of Classification Search
CPC ..... H01R 4/08; H01R 4/646
USPC ..... 439/118; 174/90, 78
See application file for complete search history.

(56) References Cited

U.S. PATENT DOCUMENTS 3,435,126 A * 3/1969 Hamilton ..... H01R 4/2495 174/78

* cited by examiner

*Primary Examiner* — Phuong Chi T Nguyen
(74) *Attorney, Agent, or Firm* — Brouillette Legal Inc.; Robert Brouillette

(57) ABSTRACT

The present invention relates to a self-locking wire device being adapted to receive at least one wire according to at least one insertion direction, the self-locking device comprises a housing being electrically insulating and a locking element being electrically conductive. The locking element comprises one or more bases extending all along an inner side of the housing and at least one locking portion being configured in a way to block any movement of the at least one wire in a direction being opposite to the insertion direction.

20 Claims, 6 Drawing Sheets

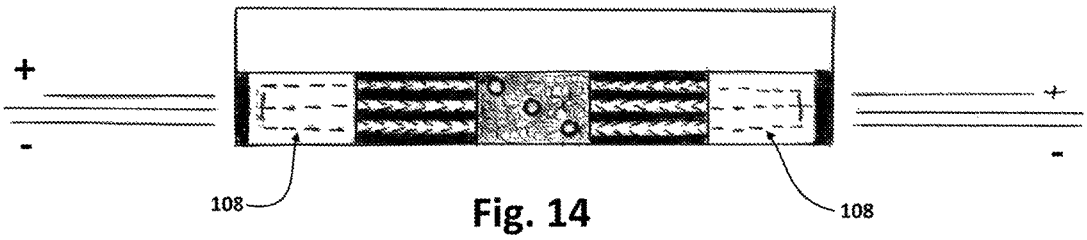
Fig. 14
Fig. 13
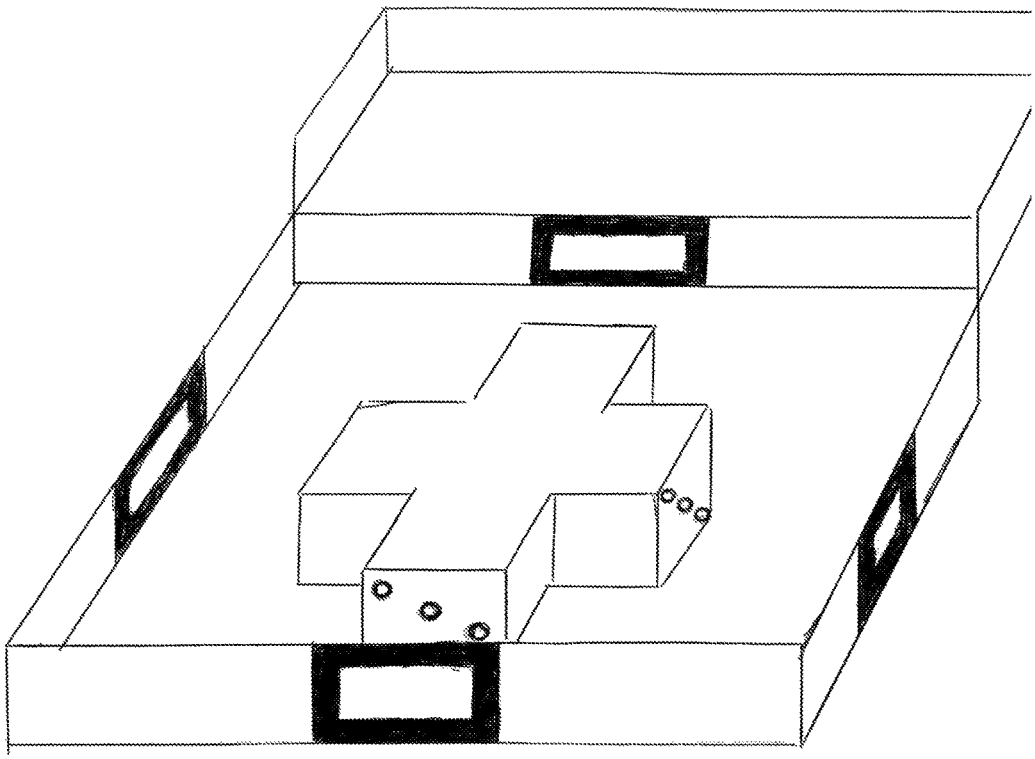

SELF-LOCKING WIRE DEVICE AND METHOD OF USING THE SAME

CROSS-REFERENCE TO RELATED APPLICATIONS

The present patent application claims the benefits of priority of U.S. Provisional Patent Application No. 62/496,450, entitled "Self-Locking Wire Nut System", and filed at the United States Patent and Trademark Office on Oct. 19, 2016, the content of which is incorporated herein by reference.

FIELD OF THE INVENTION

The present invention generally relates to the field of wire connectors and/or devices to join a plurality of wires. More particularly, the present invention relates to the field a self-locking wire device.

BACKGROUND OF THE INVENTION

Conventionally, various wire connectors and devices have been developed to connect wires or cables. However, the plurality of these connectors and devices comprises fasteners and attachment means which need to be disassembled and then assembled each time a wire is needed to be relocated. Such connectors and devices require a hand operated assembling/disassembling process which becomes not only exhausting to the operator by the end of the day but definitely costly for a user.

Besides, conventional wire connectors and devices are generally adapted to be in use with a predetermined length of wires. Thus, in the case of a pre-set electrical installation, once a wire brakes, the operator has to disconnect the broken wire from the installation and to replace it by a new wire.

Thus, there is still a need for a device allowing joining a plurality of wires without having a need to use any tool and independently of the parameters of a pre-set installation such as the length of wires.

SUMMARY OF THE INVENTION

The shortcomings of the prior art are generally mitigated by providing a self-locking wire device allowing to receive a cable or a wire and to lock the cable or the wire with an electrically conductive structure.

The present invention provides a self-locking wire device. The self-locking wire device having a first and a second end. The self-locking device comprises a first inner portion at the first end and a second inner portion at the second end. The first inner portion and second inner portion being adapted to receive at least one wire. Each first and second inner portion comprises at least one locking element allowing movement of the at least one wire in a first direction and blocking movement in a second direction being opposite to the first direction wherein each locking element is made of electrical conductive material.

In one aspect of the invention, each locking element further comprises a plurality of locking portions and each locking portion defines an internal central crown of angled teeth.

In another aspect of the invention, the at least one locking portion is angled toward center of the self-locking wire device. The at least one locking portion is angled with respect to the inner portions at an angle about 45°.

In another aspect of the invention, the first inner portion is in electrical contact with the second inner portion through the locking elements.

In yet another aspect of the invention, the self-locking wire device comprises a separating member adapted to divide the first inner portion from the second inner portion. The separating member may be made of electrical conductive material. The separating member is substantially perpendicular to the first and second inner portions.

In yet another aspect of the invention, the self-locking wire device further comprises a housing adapted to receive the first and second inner portions. The housing is made of non-conductive material.

In yet another aspect of the invention, at least one locking element comprises an internal central crown of angled teeth alternated with one or more electrically conductive hollow rods.

In yet another aspect of the invention, the self-locking wire device may be a unidirectional self-locking wire device, wherein one or more first locking portions relates to a first insertion direction and one or more second locking portions related to a second insertion direction, the first and second insertion being opposite.

In another aspect of the invention, the self-locking wire device comprises at least three inner portions. The three inner portions may be forming a T. The three inner portions forming a Y.

The present invention also provides a method for connecting a plurality of wires, the method comprises inserting at least a first wire into a first inner portion of a self-locking wire device, the first inner portion allowing movement of the at least one wire in the inserting direction and blocking movement in an opposite direction to the insertion and inserting at least a second wire into a second inner portion electrically conductive with the first inner portion, the second inner portion allowing movement of the at least one wire in the inserting direction and blocking movement in an opposite direction to the insertion.

In another aspect of the invention, the method further comprises holding a housing being made of non-conductive material, the housing comprises the first and the second inner portion prior to inserting the wires.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which:

FIG. 13 is a perspective view of another embodiment of a multi-branch self-locking wire device shown within a casing in accordance with the principles of the present invention.

FIG. 14 is a sectional view of the multi-branch self-locking wire device of FIG. 13.

DETAILED DESCRIPTION OF THE PREFERRED EMBODIMENT

A novel self-locking wire device and method of using the same will be described hereinafter. Although the invention is described in terms of specific illustrative embodiments, it is to be understood that the embodiments described herein are by way of example only and that the scope of the invention is not intended to be limited thereby.

Figure 1:
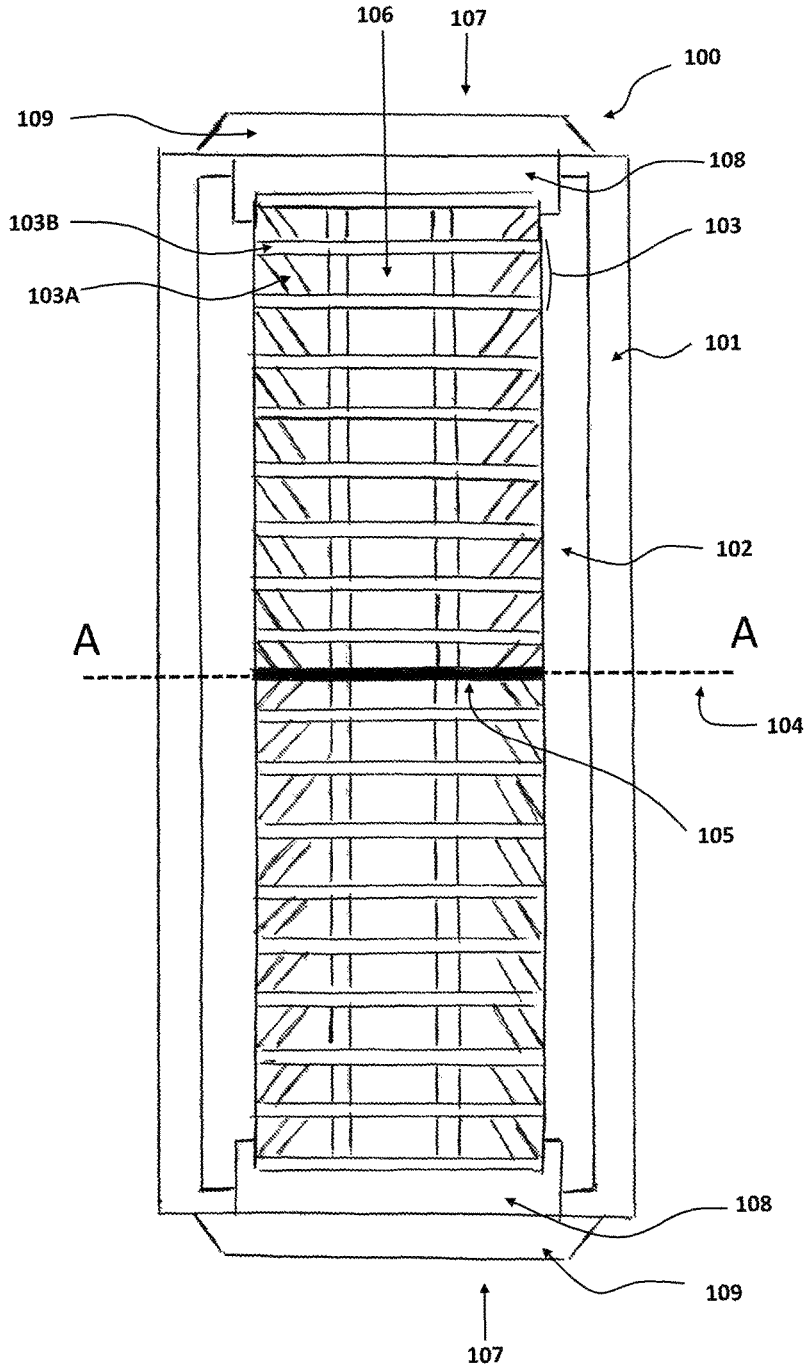
FIG. 1 is a front sectional view of an embodiment of a self-locking wire device in accordance with the principles of the present invention.
Figure 2:
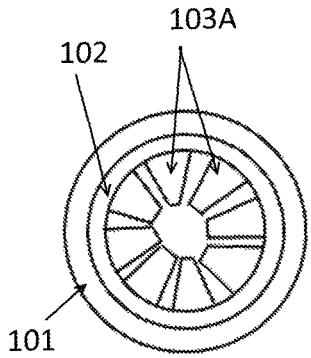
FIG. 2 is a sectional top view of the self-locking wire device of FIG. 1.

Referring to FIGS. 1 and 2, a first embodiment of a self-locking wire device 100 is illustrated. The self-locking wire device 100 comprises a housing 101 adapted to receive a conductive support structure 102 generally adapted to receive one or more locking element 103. The locking element 103 is adapted to receive a cable or wire and, once the cable or wire is received, to lock the cable or wire with regard to the conductive support structure. As illustrated by FIG. 1, the locking elements 103 are in electrical contact, typically through the conductive support structure.

In some embodiments, the self-locking wire device may comprise a housing 101 adapted to receive the support structure 102 or to cover the support structure 102. The housing 101 is preferably made of an electrically insulating material while the support structure 102 is preferably made of an electrically conductive material.

In the embodiment as shown in FIGS. 1 and 2, the housing 101 and the support structure 102 have cylindrical shapes, the inner cavity adapted to receive the cable also being cylindrically shaped. Understandably, any other shape or format could be used without departing from the scope of the present invention.

Still referring to FIGS. 1 and 2, in a preferred embodiment, each locking element 103 comprises a locking portion 103A being supported by a base 103B. The base 103B is configured to be rigidly attached to the support structure 102. Each locking portion 103A is preferably angled towards the inner portion 106 of the self-locking wire device 100 and in the same direction of the wire insertion direction 107 from each side of the self-locking wire device 100. As the cable is inserted toward the inner portion 106 of the self-locking device 100, the angled shape of the locking portion 103A allow the passage of the wire within the self-locking device 100. When the wire is fully inserted within the cavity of the self-locking device, the locking portion 103 prevents the wire from being moved toward the outer portion of the self-locking device 100. Each locking portion 103A is preferably angled with respect to each base 103B at an angle of about 45°. Each of the locking elements 103 is preferably made of an electrically conductive material. The locking elements 103 are preferably symmetrically arranged with respect to a median plan 104 of the self-locking wire device 100.

Still referring to FIGS. 1 and 2, in some embodiments, a separating member 105 is preferably within the inner cavity 106 to separate the locking elements 103 related to each side of the self-locking wire device 100. The separating member 105 is generally positioned at the center of the passage of the wire and prevents a cable being inserted from on end of the self-locking device 100 to overlap the other side of the device 100. The separating member 105 is typically perpendicularly oriented with regard to the wire insertion direction 107.

In a further embodiment, the locking elements 103 may be made of machined standard locking nuts defining an internal central crown of angled teeth defining locking portions 103A. The standard locking nuts are preferably made of electrical conductive material. Such locking nuts may be glued one to another or pressed one against another and retained by the housing 101 or other retaining member.

In another embodiment, the inner portion 106 of the self-locking wire device 100 may be made of machined standard washers defining an internal central crown of angled teeth defining locking portions 103A and being alternately disposed with electrically conductive hollow rods. The standard washers are preferably made of electrical conductive material. Such washers may be glued one to another or be pressed again one another and retain by the housing 101 or other retaining member.

Still referring to FIGS. 1 and 2, the self-locking wire device 100 may further comprise an air chamber 108 located on each side of the self-locking wire device to allow easy and secure insertion of wires. The self-locking wire device 100 may further comprise a resilient member 109 adapted to firmly secure each extremity of the self-locking device to the to-be-inserted wire.

Understandably, the locking elements 103 may be glued one to another or pressed one against another and retained by the housing 101 or other retaining member. Thus, any assembling process may be applied to ensure the structural integrity and the internal electrical conductivity of the self-locking wire device 100.

Figure 3:
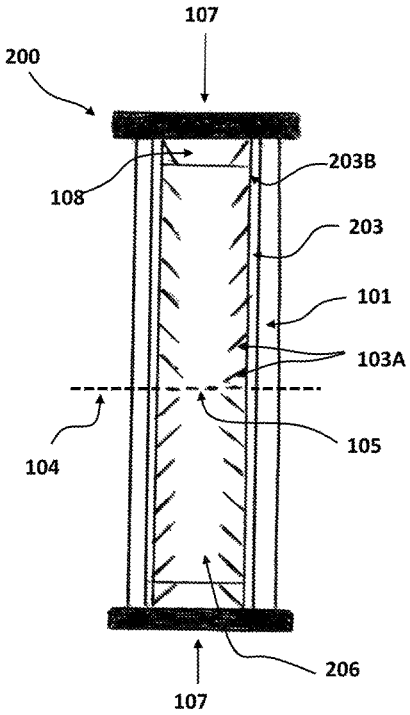
FIG. 3 is a front sectional view of another embodiment of a self-locking wire device in accordance with the principles of the present invention.

Referring now to FIG. 3, another preferred embodiment of a self-locking wire device 200 is illustrated. The self-locking wire device 200 may comprise a housing 101 adapted to receive a locking element 203 comprising a base 203B supporting one or more locking portion 103A. The housing 101 is preferably made of an electrically insulating material while the locking element 203 is preferably made of an electrically conductive material. In such a configuration, the inner part 206 of the self-locking wire device 200 is shaped preferably as one piece being electrically conductive.

Understandably, although being shaped preferably as one electrically conductive part, the locking portions 103A of the locking element 203 are preferably angled towards the inner of the self-locking wire device 200 and in the same direction of the wire insertion direction 107 from each side of the self-locking wire device 200 in order to prevent an inserted wire to exit the cavity 206. Each locking portion 103A is preferably angled with respect to the base 203B. In a preferred embodiment, the angle is about 45°. The locking portions 103A are preferably symmetrically arranged with respect to a median plan 104 of the self-locking wire device 200.

In some embodiments, a separating member 105 is preferably within the inner cavity 206 to separate the locking elements 103 related to each side of the self-locking wire device 200. The separating member 105 is generally positioned at the center of the passage of the wire and prevents a cable being inserted from on end of the self-locking device 200 to overlap the other side of the device 200. The separating member 105 is typically perpendicularly oriented with regard to the wire insertion direction 107. The separating member 105 may be made of electrical conductive material.

Figure 4:
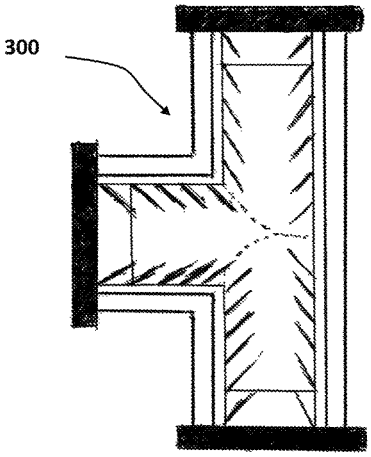
FIG. 4 is a front sectional view of a three-branch self-locking wire device in accordance with the principles of the present invention.
Figure 5:
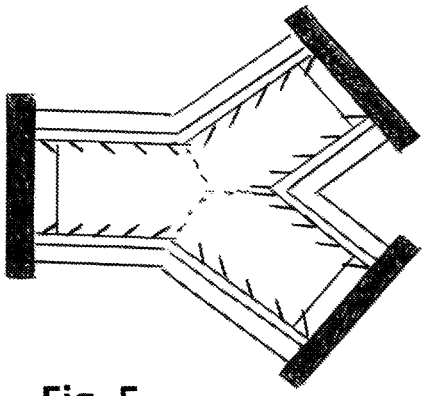
FIGS. 5-6 are front sectional views of different embodiments of a multi-branch self-locking wire device in accordance with the principles of the present invention

Referring now to FIGS. 4 and 5, embodiments of three-branch self-locking wire devices 300 are illustrated. The self-locking device 300 comprises more at least three inner portions, each adapted to receive and hold a wire or cable. Each inner portion comprises a locking device. As shown in FIG. 4, the self-locking wire device 300 may have a T-shape. As shown in FIG. 5, the self-locking wire device 300 may have a Y-shape. The self-locking device 300 as shown generally provides inserting three conductive wires in each cavity.

Understandably, the locking portions 103A are arranged in a way to prevent a wire to be detached or to exit the inner portion. In other word, the locking portions 103A prevent a wire inserted in a first direction, typically toward the center of the device 300, to move in an opposite direction, typically toward the outside ends of the device 300.

Figure 6:
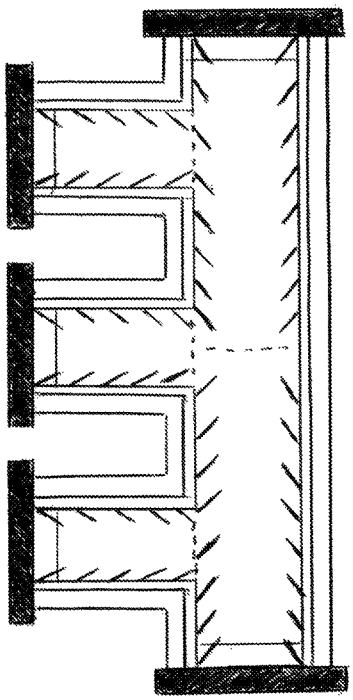

Referring now to FIG. 6, another embodiment of a multi-directional self-locking device is illustrated. The illustrated self-locking device comprises a plurality of ends to interconnect a plurality of wires. Each end provides inserting a conductive wire to connect them.

Figure 7:
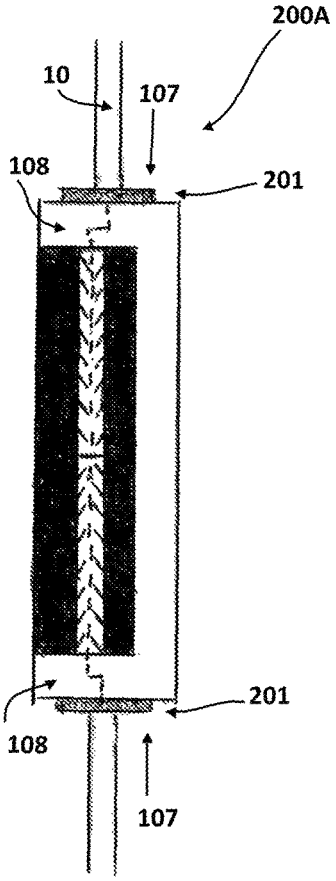
FIG. 7 is a front sectional view of an embodiment of a self-locking wire device adapted to receive lower current tolerance in accordance with the principles of the present invention.

Referring now to FIG. 7, a first arrangement of a self-locking device 200A is illustrated. The self-locking device 200A is configured for use with a single conductor cable. Thus, in such an embodiment, once a conductor or wire 10 is introduced to one side 201 of the self-locking device 200A, the wire 10 first crosses an air chamber 108 then engages one or more locking portions 103A of the locking elements 203 or 103.

Understandably, once engaging the locking portions 103A, the wire 10 is firmly and rigidly maintained in place. The angled position of the locking portions 103A prevents the detachment of the wire 10 if pulled in a direction opposite of the insertion direction 107. The angled position of the locking portions 103A blocks the movement of the wire 10 in a direction opposite of the insertion direction 107.

Figure 8:
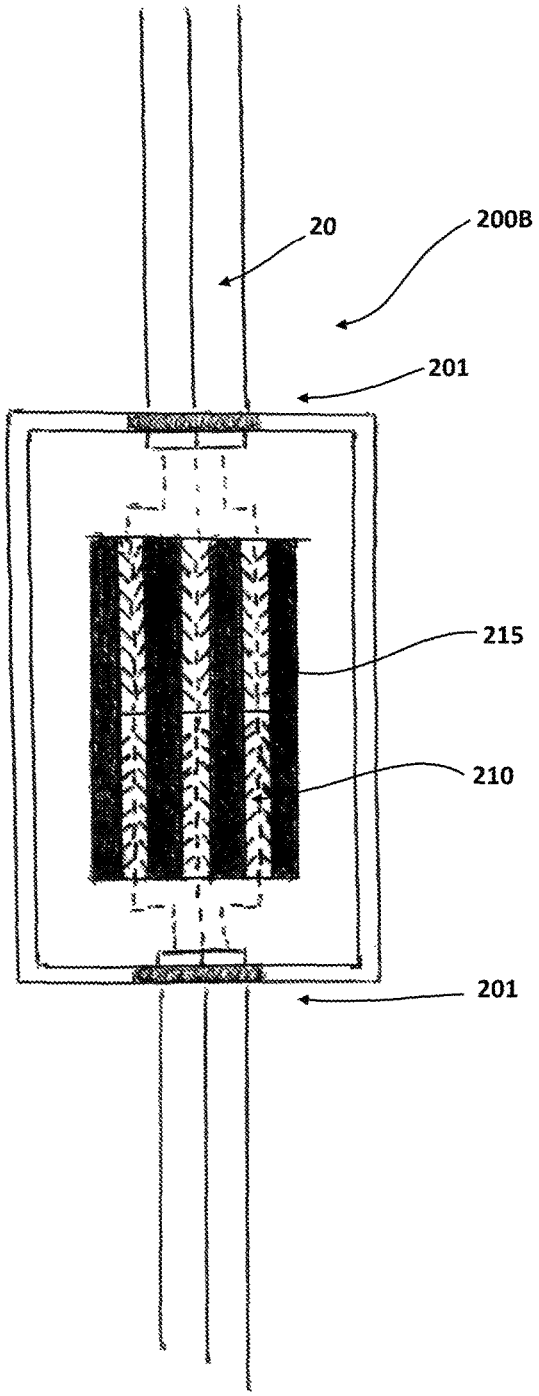
FIG. 8 is a front sectional view of an embodiment of a self-locking wire device adapted to receive three-wire cable in accordance with the principles of the present invention.
Figure 9:
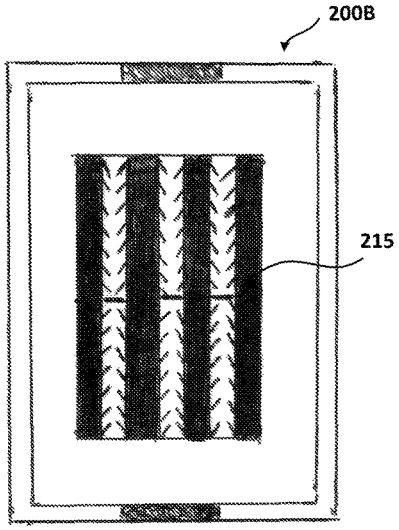
FIG. 9 is a front sectional view of an embodiment of a self-locking wire device within a case in accordance with the principles of the present invention.

Referring now to FIGS. 8 and 9, a second arrangement of a self-locking device 200B is illustrated. The self-locking device 200B is a multi-conductor self-locking device 200B. Thus, once a multi-conductor or wire cable 20 is introduced to one side 201 of the self-locking device 200B, the multi-wire cable 20 crosses first an air chamber or empty space 108 then each conductor or wire of the cable 20 individually engages a branch 210 of the self-locking device 200B. Each wire of the cable 20 engages then one or more locking portions 103A of the locking elements 203 or 103.

Understandably, once engaging the locking portions 103A, each branch of the wire 20 is firmly and rigidly maintained in place. The angled position of the locking portions 103A prevent the detachment of the branch of the wire 20 once being pulled in an opposite direction of the insertion direction 107. The angled position of the locking portions 103A blocks the movement of any one of the branches of the wire 20 in an opposite direction of the insertion direction 107.

Understandably, the device may be configured to connect three or more conductors or wires together (example: FIGS. 4, 5 and 6).

Figure 11:
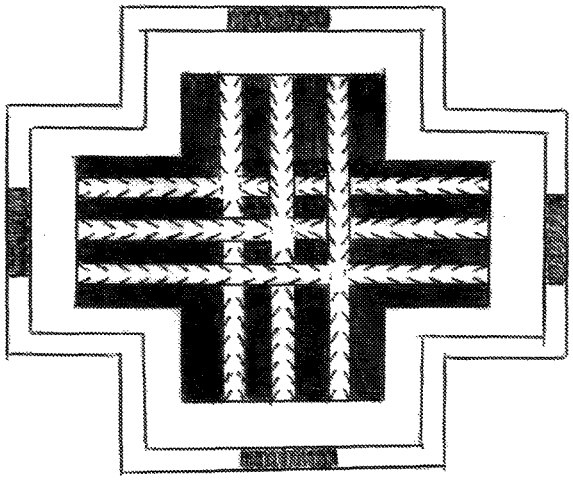
FIGS. 11-12 are front sectional views of different embodiments of a multi-branch self-locking wire device showing different inner branch arrangements in accordance with the principles of the present invention
Figure 12:
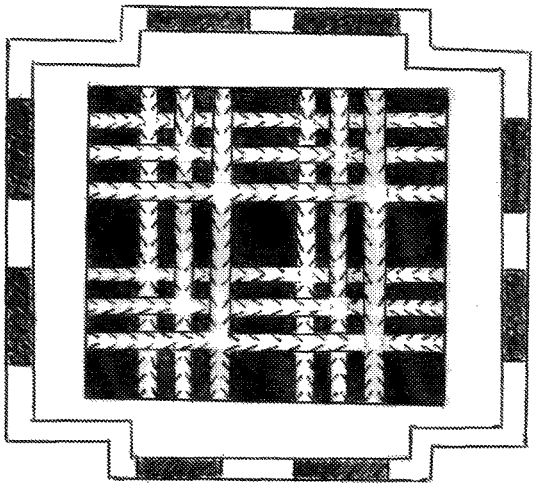
Figure 10:
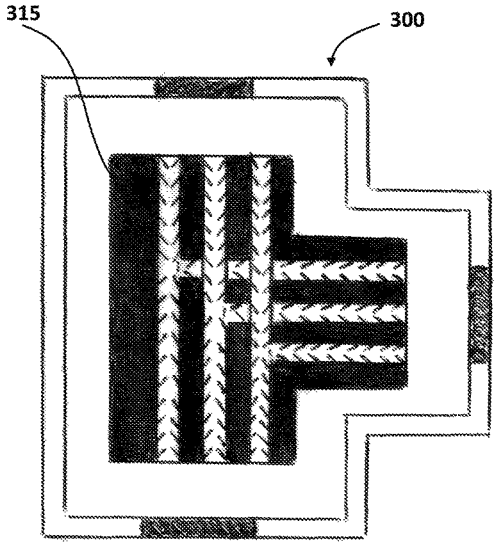
FIG. 10 is a front sectional view of a three-branch self-locking wire device shown within a case in accordance with the principles of the present invention.

As shown in FIGS. 10, 11 and 12, a single self-locking wire device may be used to connect a plurality of electrically insulated conductors or wires. Understandably any electrically insulating material (see 215 and 315) known in the art may be used to ensure the inner insulation between the different wires.

Figure 15:
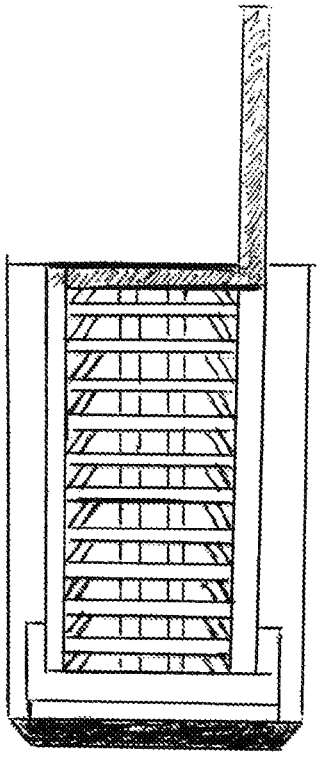
FIG. 15 is a sectional view of another embodiment of a self-locking wire device being configured to be connected to an output/input of an electrical component.

Referring now to FIG. 15, a self-locking wire device 400 is configured to be connected to an input/output of an electrical component is illustrated. The self-locking wire device 400 is configured to be connected to an input/output of an electrical component such as a transformer. The self-locking wire device 400 is adapted to connect a wire to an electrical component while preventing any possible detachment of the wire if pulled in a direction opposite to the insertion direction.

Preferably, each locking portion 103A is adapted to support preferably a pulling stress of 2001*b*.

In another embodiment, the self-locking device 100 is preferably configured to be waterproof.

In another preferred embodiment, the self-locking wire device is configured to be reusable.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

What is claimed is:

1. A self-locking device connecting a first wire to a second wire, the self-locking device comprising:

a first and a second end;

a first inner portion at the first end adapted to receive the first wire, the first inner portion comprising at least one first locking element; the first locking elements allowing movement of first wire in a first longitudinal direction relative to the first locking element and blocking movement of the first wire in another direction being opposite to the first direction;

a second inner portion at the second end adapted to receive the second wire, the second inner portion comprising at least one second locking element, the second locking elements allowing movement of the second wire in a second longitudinal direction relative to the second locking element and blocking movement of the second wire in another direction being opposite to the second direction;

wherein each locking element is made of an electrically conductive material;

wherein the first locking element is in electrical contact with the second locking element.

2. The self-locking device of claim 1, wherein the first inner portion is in electrical contact with the second inner portion through the first and second locking elements.

3. The self-locking device of claim 1, wherein at least one locking element comprises an internal central crown of angled teeth alternated with one or more electrically conductive hollow rods.

4. The self-locking device of claim 1 being a unidirectional self-locking device, wherein one or more first locking portions are configured to allow a first insertion direction and one or more second locking portions are configured to allow a second insertion direction, the first and second insertion being opposite to each other.

5. The self-locking device of claim 1, wherein the self-locking device is waterproof.

6. The self-locking device of claim 1, wherein the self-locking device further comprises a housing adapted to receive the first and second inner portion.

7. The self-locking device of claim 6, the housing being made of non-conductive material.

8. The self-locking device of claim 1, wherein the self-locking device comprises a separating member adapted to divide the first inner portion from the second inner portion.

9. The self-locking device of claim 8, wherein the separating member is made of electrical conductive material.

10. The self-locking device of claim 8, the separating member being substantially perpendicular to the first and second inner portion.

11. The self-locking device of claim 1, wherein the self-locking device comprises at least three inner portions.

12. The self-locking device of claim 11, wherein the three inner portions form a T.

13. The self-locking device of claim 11, wherein the three inner portions form a Y.

14. The self-locking device of claim 1, wherein each locking element further comprises a plurality of locking portions.

15. The self-locking device of claim 14, wherein each locking portion defines an internal central crown comprising angled teeth.

16. The self-locking device of claim 14, wherein each locking portion blocks movement having a load of at least 200 pounds.

17. The self-locking device of claim 14, wherein the at least one locking portion is angled toward the center of the self-locking device.

18. The self-locking device of claim 17, wherein the at least one locking portion is angled with respect to the inner portions at an angle of about 45°.

19. A method for connecting a plurality of wires using a self-locking device, the method comprising:

inserting at least a first wire into a first self-locking inner portion of the self-locking device in a first longitudinal insertion direction, the first self-locking inner portion allowing movement of the at least first wire relative to the first self-locking inner portion in the first insertion direction and blocking movement of the at least first wire in a direction opposite to the first insertion direction;

inserting at least a second wire into a second self-locking inner portion electrically conductive with the first inner portion in a second longitudinal insertion direction, the second inner portion allowing movement of the at least second wire relative to the first self-locking inner portion in the second insertion direction and blocking movement of the at least second wire in a direction opposite to the second insertion direction.

20. The method of claim 19, the method further comprising manipulating a housing prior to inserting the wires, the housing being made of non-conductive material and comprising the first and the second inner portion.

* * * * *